United States Patent [19]

Hashida et al.

[11] Patent Number: 4,997,175

[45] Date of Patent: Mar. 5, 1991

[54] SHEET FOLDING APPARATUS

[75] Inventors: Yoshisuke Hashida; Hidèo Takaoka, both of Tokyo; Yoshiharu Kamei, Urawa, all of Japan

[73] Assignee: Sun Seiki Co., Ltd., Tokyo, Japan

[21] Appl. No.: 355,644

[22] Filed: May 23, 1989

[51] Int. Cl.[5] ..... B42C 1/00

[52] U.S. Cl. ..... 270/45; 493/419

[58] Field of Search ..... 270/32, 45, 47, 51; 493/405, 408, 419, 442

[56] References Cited

U.S. PATENT DOCUMENTS

| | | | |
|---|---|---|---|
| 4,202,621 | 5/1980 | Yoshimura | 493/420 |
| 4,403,981 | 9/1983 | Wathrich | 493/442 |

FOREIGN PATENT DOCUMENTS

| | | | |
|---|---|---|---|
| 63-1676 | 1/1988 | Japan | 270/47 |
| 63-134471 | 6/1988 | Japan | 270/32 |

*Primary Examiner*—Edward K. Look
*Assistant Examiner*—Therese M. Newholm
*Attorney, Agent, or Firm*—Finnegan, Henderson, Farabow, Garrett & Dunner

[57] ABSTRACT

A sheet folding apparatus comprises a feed roller mechanism consisting of a pair of roller adapted to feed a sheet clamped therebetween, a working roller mechanism mounted on the outlet side of the feed roller mechanism consisting of a central roller, a press roller in press contact with one side of the central roller, and a shift press roller in press contact with the other side of the central roller, and a shift guide mechanism mounted between the feed roller mechanism and the working roller mechanism. The shift press roller of the working roller mechanism is held for shifting movement between a first or access position where it is opposed to the press roller and a second or shifted position where it is in press contact with the other side of the central roller, along an outer peripheral surface of the central roller in a condition remaining in press contact with the central roller. The shift guide mechanism includes a pair of guide plates defining a sheet passage, and is shiftable between a normal position and a shifted position in operative association with the shift press roller. The apparatus can fold a sheet a plurality of times.

5 Claims, 4 Drawing Sheets

SHEET FOLDING APPARATUS

BACKGROUND OF THE INVENTION

1. Field of the Invention

The present invention relates to a sheet folding apparatus for folding a large sheet, e.g., a drawing sheet.

2. Description of the Prior Art

To file a large sheet such as a design drawing of a blueprint, it is generally necessary to fold the sheet into a proper size. However, there is no conventioanlly known apparatus for folding a large sheet, which is of practical use.

An apparatus for folding a sheet with a knife edge located along a central folded line of the sheet in such a manner to overlap opposite end edges of the sheet over each other may be used in some case in a printing office. However, such apparatus is very large-sized.

SUMMARY OF THE INVENTION

It is an object of the present invention to provide a sheet folding apparatus which is of a simple construction and capable of folding a sheet in a multiple manner.

According to the present invention, there is provided a sheet folding apparatus comprising a feed roller mechanism consisting of a pair of rollers adapted to feed a sheet clamped therebetween; a working roller mechanism mounted on the outlet side of the feed roller mechanism in a line in the same direction as the pair of rollers of the feed roller mechanism and consisting of a central roller, a press roller in press contact with one side of the central roller, and a shift press roller in press contact with the other side of the central roller; and a shift guide mechanism mounted between the feed roller mechanism and the working roller mechanism, the shift press roller of the working roller mechanism being held for shifting movement between a first or access position where it is opposed to the press roller and a second or shifted position where it is in press contact with the other side of the central roller, along an outer peripheral surface of the central roller in a condition remaining in press contact with the central roller, the shift guide mechanism including a pair of guide plates defining a sheet passage, and being shiftable between a normal position and a shifted position in operative association with the shift press roller, the shift guide mechanism being designed so that when it is in the normal position, an inlet thereof is located at a nip of the feed roller mechanism, while an outlet thereof is directed to a nip between the central roller and the press roller in the working roller mechanism, and when it is in the shifted position, the inlet is located at the nip of the feed roller mechanism, while the outlet is directed to the nip betweem the central roller of the working roller mechanism and the shift press roller in the shifted position, whereby the sheet is folded through the following steps;

a step A of passing the sheet fed by the feed roller mechanism between the central roller and the press roller in the working roller mechanism with the shift guide mechanism in the normal position;

a step B of shifting the shift guide mechanism from the normal position to the shifted position, moving and shifting the shift press roller from the normal position to the shifted position along the outer peripheral surface of the central roller in a condition remaining in press contact with the central roller, while at the same time, reversely rotating the central roller, and passing the sheet, with a sheet portion reversely fed by the central roller and the press roller and a succeeding sheet portion fed by the feed roller mechanism being overlapped over each other, between the central roller and the shift press roller, thereby folding the sheet; and a step C of shifting the shift guide mechanism from the shifted position to the normal position, returning the shift press roller in a condition remaining in press contact with the central roller along the outer peripheral surface of the central roller to the access position, while at the same time, again reversing the central roller, and passing the folded sheet portion reversely fed by the central roller and the shift press roller and a further succeeding sheet portion fed by the feed roller mechanism, in a condition of these sheet portions overlapped over each other, between the central roller and the shift press roller, thereby folding sheet.

The sheet folding apparatus according to the present invention is of a simple construction and small-sized, and enables a large sheet to be reliably folded a plurality of times.

DESCRIPTION OF THE PREFERRED EMBODIMENT

The present invention will now be described by way of one embodiment with reference to the accompanying drawings.

Figure 1:
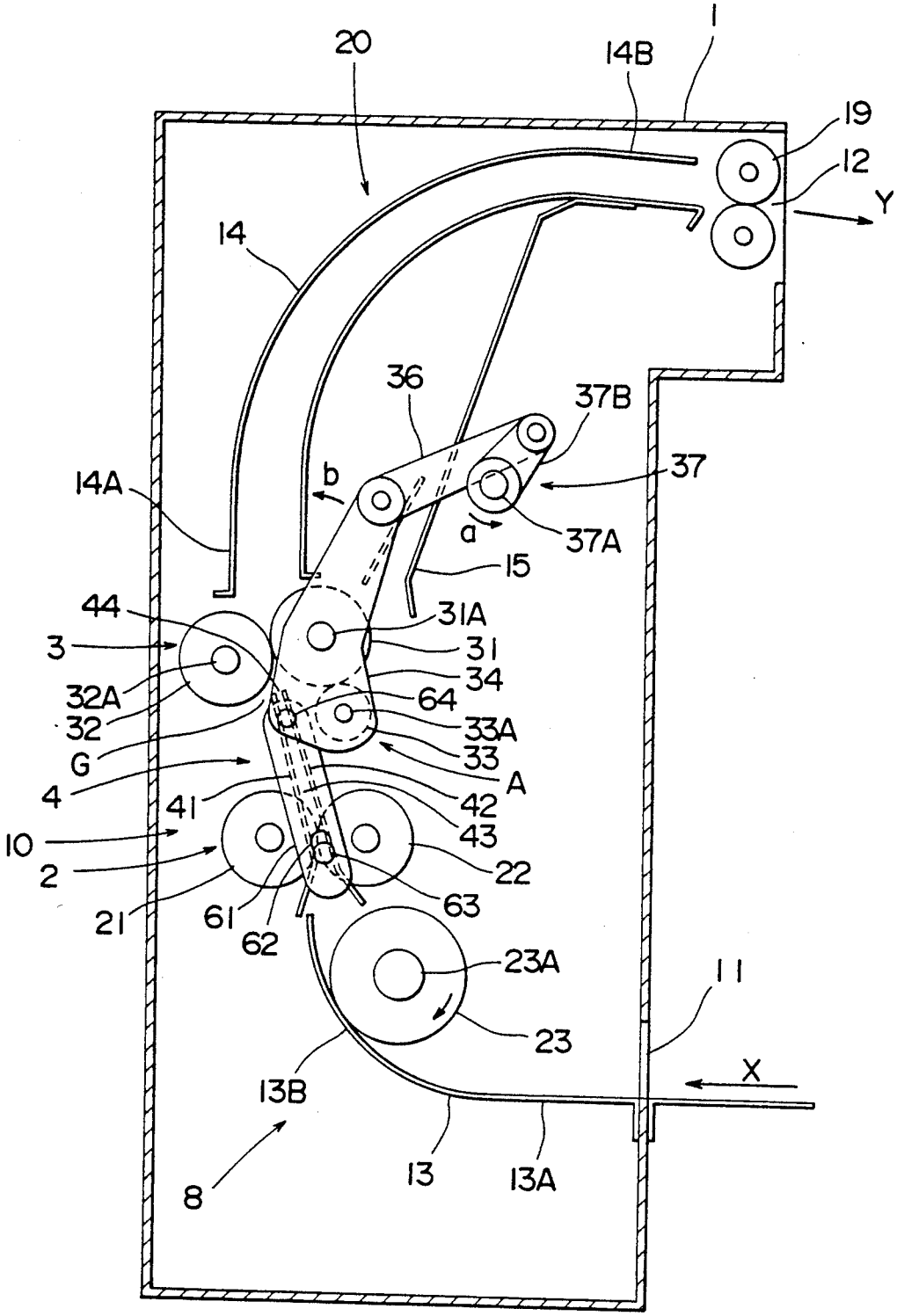
FIG. 1 is a longitudinal sectional view schematically illustrating the construction of one embodiment of a sheet folding apparatus according to the present invention, which is in a normal condition.
Figure 2:
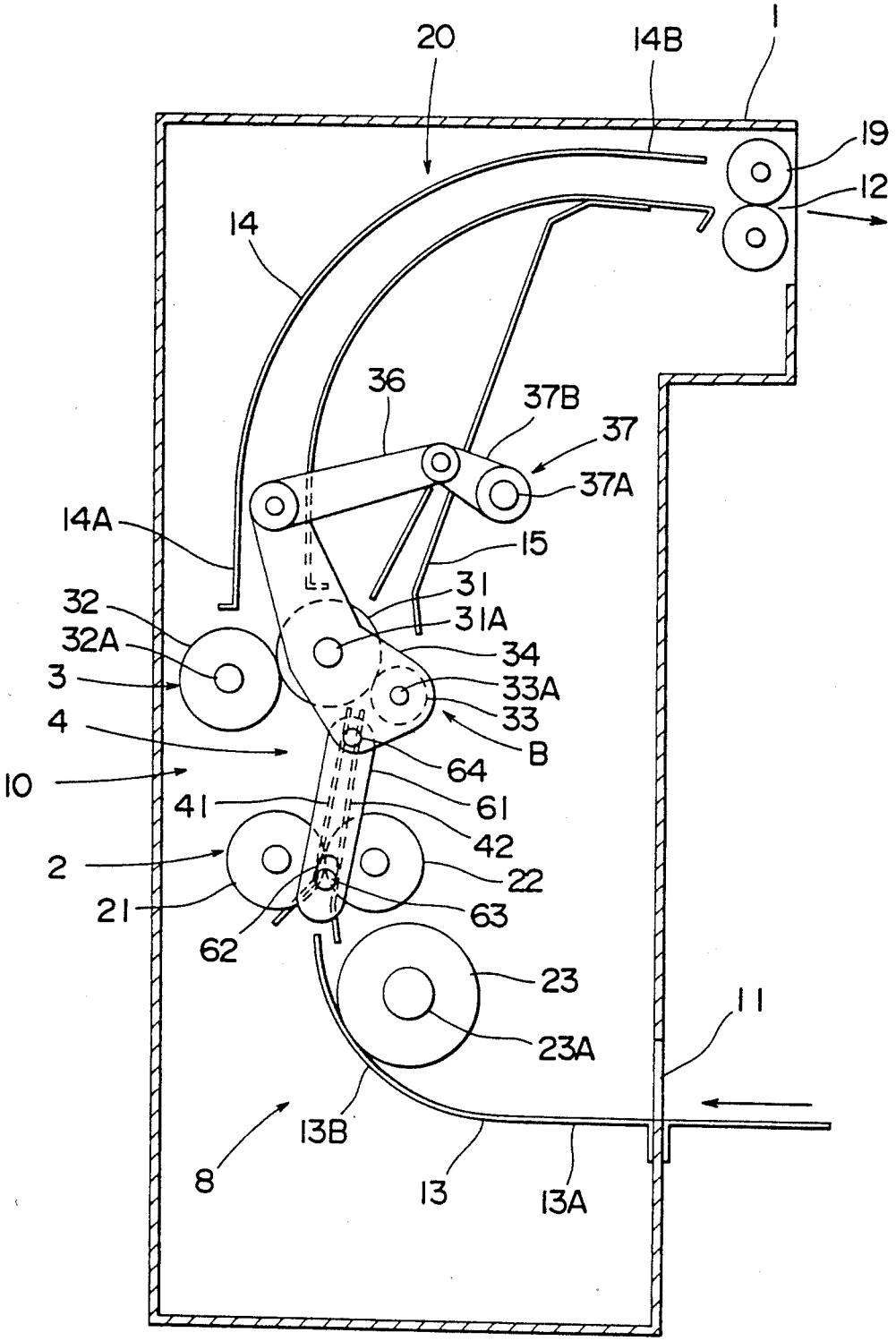
FIG. 2 is a longitudinal sectional view of the apparatus shown in FIG. 1, which is in a shifted condition.

FIGS. 1 and 2 are longitudinal sectional views of one example of a sheet folding apparatus according to the present invention, FIG. 1 illustrating such apparatus in a normal condition, and FIG. 2 illustrating the same in a shifted condition.

In these figures, the reference numeral 1 is a so-called vertical housing which is provided, at a lower portion of its front face, with a sheet insert opening 11 through which a sheet to be folded is inserted along an arrow X. The housing 1 is also provided, at an upper portion of its front face, with a sheet discharge opening 12 through which the folded sheet is discharged along an arrow Y.

Provided in the housing 1 in sequence from the below are an introducing mechanism 8, a folding mechanism 10 and a discharging mechanism 20.

The introducing mechanism 8 includes an introduction guide plate 13 which comprises a horizontal portion 13A located in association with the sheet insert opening 11 and a curved portion 13B connected to the horizontal portion 13A and upwardly extending in a curved manner. An introducing roller 23 is rotatably mounted on a drive shaft 23A to slip on a guide surface of the curved portion 13B.

The folding mechanism 10 comprises a feed roller mechanism 2, a working roller mechanism 3 and a shift guide mechanism 4.

The feed roller mechanism 2 is comprised of a pair of rollers 21 and 22 horizontally arranged in press contact with each other, with a nip located above a leading end of the curved portion 13B of the introducing guide plate 13. The rollers 21 and 22 function to advance a sheet clamped therebetween. Each of the rollers 21 and 22 is designed to be splitted in a plurality of roller elements which are mounted on the common shaft separated with each other in a longitudinal direction of the shaft so as to form a clearance between respective adjacent roller elements. Accordingly, the rollers 21 and 22 come into contact with only some widthwise portions of the sheet.

The working roller mechanism 3 is disposed above the feed roller mechanism 2 and comprises a central roller 31 disposed just above the nip of the feed roller mechanism 2, a press roller 32 disposed on one side (on a left side as viewed in FIG. 1) of the central roller 31 and in press contact therewith, and a shift press roller 33 which is in press contact with the central roller 31 in a first or access position A where it comes close to the press roller 32 and is opposed thereto with a gap G left therebetween in a normal condition and which is adapted to be moved for shift between the access position and a second or shifted position B. All of these central, press and shift guide rollers 31, 32 and 33 come into contact with the widthwise entire sheet.

The central roller 31 of the working roller mechanism 3 is carried on a support shaft 31A provided at a fixed place relative to the housing 1, and the press roller 32 is carried on a support shaft 32A which is biased, for example, by a resilient force of a spring, so that it may be spaced apart by a slight distance from the support shaft 31A of the central roller 31.

The shift press roller 33 is held for shift movement between the first position A and the second position B along an outer peripheral surface of the central roller 31 in a state remaining in press contact with the central roller 31. More specifically, a pair of connecting plates 34 are pivotally connected at locations outward from opposite ends of the support shaft 31A of the central roller 31 for pivotal movement about the support shaft 31A in an opposed relation to each other, and the shift press roller 33 is carried, in press contact with the central roller 31, on the support shaft 33A provided in front (on a right side as viewed in FIG. 1) of a lower portion of the connecting plates 34. Thus, the pivotal movement of the connecting plates 34 enables the shift press roller 33 to move for shift in a state remaining in press contact with the central roller 31 along the outer peripheral surface of the central roller 31 between the access position A shown in FIG. 1 and the shifted position B where it is in press contact with the other side (a right side as viwed in FIG. 2) of the central roller 31 shown in FIG. 2. As is the press roller 32, the shift press roller 33 is also in press contact in a condition where it can be spaced apart by a slight distance from the support shaft 31A of the central shaft 31.

A shift mechanism 37 is connected to an upper end of the connecting plate 34. The shift mechanism 37 is comprised of a lever 37B fixed to a drive shaft 37A, and an arm 36 pivotally supported at one end of the lever 37B. The arm 36 is swingably connected at the other end thereof to the connecting plate 34, so that when the shift mechanism 37 is driven from the normal condition in a direction indicated by an arrow a, the upper ends of the connecting plates 34 are shifted in a direction indicated by an arrow b.

The discharge mechanism 20 includes a discharge guide 14 which is entirely curved with its base end 14A located on a discharge side of the central and press rollers 31 and 32 (this roller pair will be referred to as a first pair of rollers) of the working roller mechanism 3 and with its leading end 14B located in proximity to an introducing side of discharge rollers 19 mounted at the sheet discharge opening 12.

The introducing roller 23 and the individual rollers of the feed roller mechanism 2 and the working roller mechanism 3 as well as the discharge rollers 19 are connected by a proper power transmitting mechanism, e.g., a chain so that they may be driven by a common drive motor for rotation about their horizontal axes, and further, the shift mechanism 37 is also connected to the common drive motor by a proper power transmitting mechanism, whereby it is controlled to be driven in operative association with the feed roller mechanism 2 and the working roller mechanism 3.

The reference numeral 15 is a sheet supporting member which extends in an upward and forward (righftward as viewed in FIG. 1) inclined manner and is fixed at its upper end to the discharge guide 14, with its lower end 15A located on the discharge side of the central and shift guide rollers 31 and 33 (this roller pair will be referred to as a second pair of rollers) in the second position B. The sheet supporting member 15 is provided with a position sensor (not shown) for detecting the end of the sheet.

Figure 3:
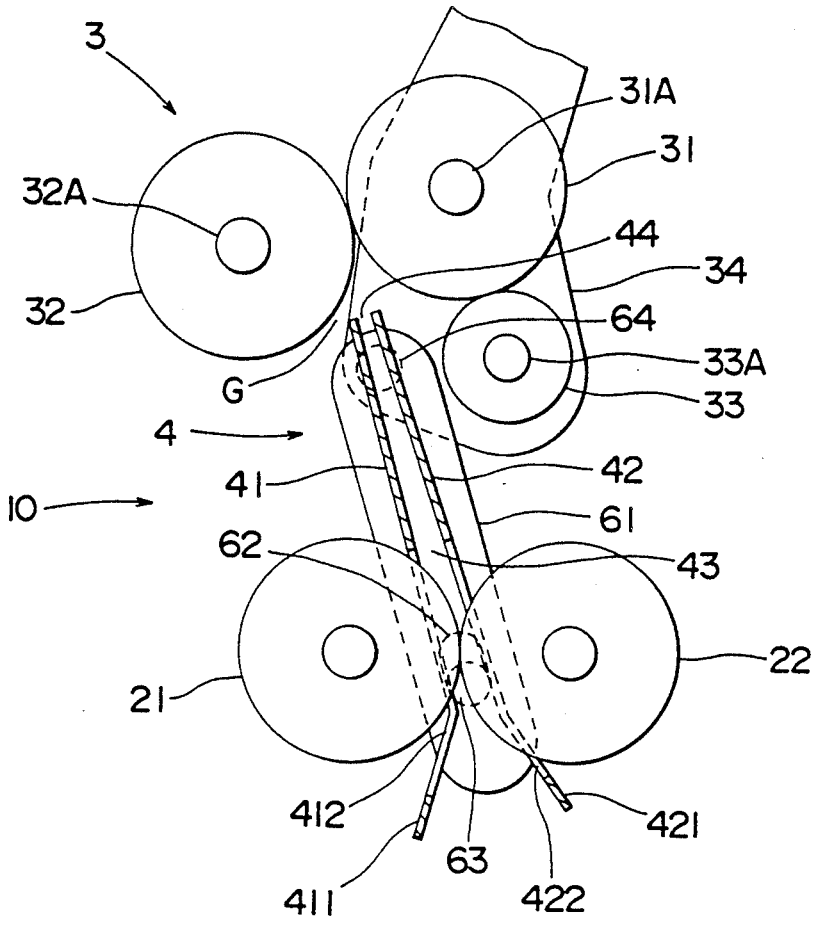
FIG. 3 is a longitudinal sectional view of an essential portion of a folding mechanism which is in the normal condition.

The shift guide mechanism 4 functions to direct the sheet from the feed roller mechanism 2 toward the first pair of rollers in the normal condition and to direct such sheet toward the second pair of rollers in the shifted condition. The shift guide mechanism 4 is comprised of a pair of elongated sideplates 61 disposed outside opposite ends of the feed roller mechanism, respectively, as shown in FIG. 3, and a pair of guide plates 41 and 42 fixed at its opposite ends to the sideplates 61 respectively and opposed to each other to define a sheet passage 43 therebetween. Each of the sideplates 61 extends from a place below the feed roller mechanism 2 to the working roller mechanism 3, and is pivotally supported at its one end (upper end) on a support shaft 64 mounted at a place in the rear (on a left side as viewed in FIG. 1) of the lower portion of the corresponding connecting plate 34. Each of a pair of shafts 63 is fixedly mounted in the vicinity of the nip of the feed roller mechanism 2 and is rotatably and movably inserted in an elongated hole 62 provided in the other end (lower end) of each sideplate 61.

The guide plates 41 and 42 extend upwradly along the sideplates 61. At each lower portions of the guide plates 41 and 42, passing parts and windows 412, 422 are formed alternately in its widthwise direction in such a manner that each of the passing parts extends through the clearances formed between the roller elements of the respective rollers 21 and 22 while the corresponding roller elements of the rollers 21 and 22 come into press-contact through the windows. The guide plates 41 and 42 have outwardly diverged inlet guide portions 411 and 421 each formed at a lower end thereof to lie below the nip of the feed roller mechanism 2, and an upper end of the introduction guide plate 13 is located between these inlet guide portions 411 and 421. An upper end of each of the guide plates 41 and 42 extends slightly beyond one end of the sideplate 61 to form a sheet outlet end 44.

Thus, the guide plates 41 and 42, in the normal condition, is in a normal position where the outlet end 44 has been directed to the nip of the first pair of rollers, and in the shifted condition, is in a shifted position where the outlet end 44 at the upper end of the shift guide mechanism 4 has been moved along with the shift press roller 33 by the pivotal movement of the connecting plates 34 so that the outlet end 44 has been directed to the nip of the second pair of rollers as shown in FIG. 2.

In the above construction, the respective rollers of the shift guide mechanism 4, the feed roller mechanism 2 and the working roller mechannism 3 are controlled in such a manner that a sheet may be multiply folded through the following steps A to C. In this manner, the folding of the sheet is achieved.

Figure 4:
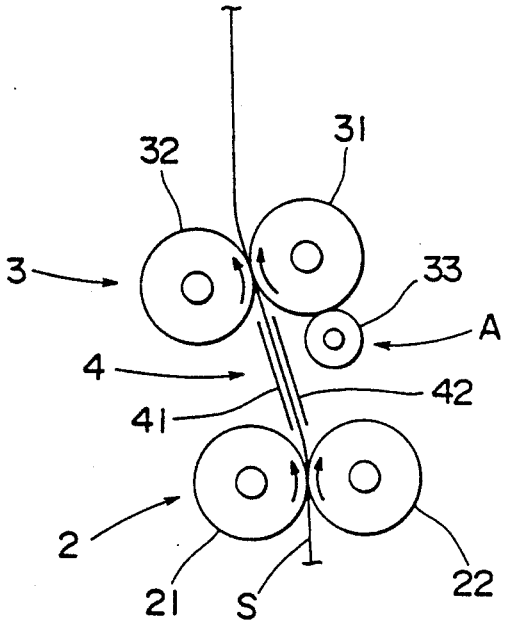
FIGS. 4 to 6 are views for illustrating the sequence of the operation of the apparatus shown in FIG. 1.

Step A:

With the shift guide mechanism 4 in the normal position and with the shift press roller 33 in the access position A, i.e., in the normal condition, as shown in FIG. 1, all rollers of the feed roller mechanism 2 and the first pair of rollers of the working roller mechanism 3 are rotated at the same linear speed in a normal direction to advance a sheet S. The sheet S to be folded is inserted through the sheet insert opening 11 and moved on the introduction guide plate 13 by rotation of the introducing roller 23. Then, it is fed between the first pair of rollers of the working roller mechanism 3 by the feed roller mechanism 2 through the shift guide mechanism 4, as shown in FIG. 4.

This operation is continued to a point when the length of a portion of the sheet S travelling beyond the nip of the first pair of rollers becomes an intended value.

Step B:

At a point when a first folded portion of the sheet S has reached the outlet end 44 of the shift guide mechanism 4, the shift mechanism 37 is operated, while at the same time, the direction of rotation of the working roller mechanism is reversed. However, the feed roller mechanism 2 is still kept rotated in the normal direction.

The operation of the shift mechanism 37 causes the upper end of the connecting plates 34 to be shifted in the direction of the arrow b, so that the connecting plates 34 are swung with their lower ends moved. As a result, the shift press roller 33 is shifted in a state remaining in press contact with the central roller 31 along the outer peripheral surface of the central roller 31 from the first or access position A to the second or shifted position B, as shown in FIG. 2, while at the same time, the upper ends of the sideplates 61 are swung with the lower ends thereof restrained by the connecting plates 34. Therefore, the outlet end 44 of the shift guide mechanism 4 is moved along the outer pripheral surface of the central roller 31 and thus shifted from the normal position to the shifted position.

Figure 5:
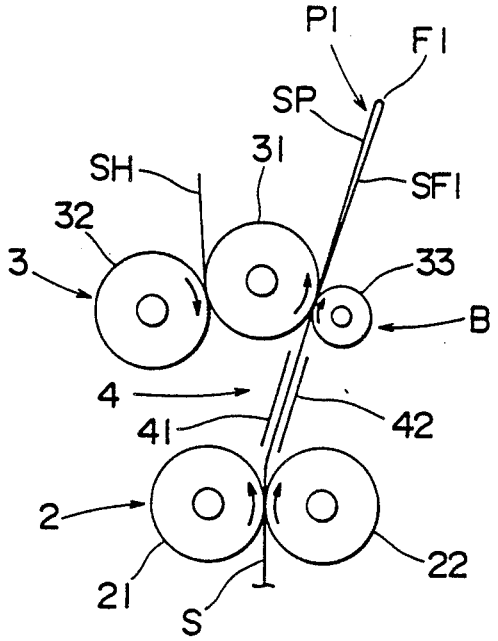

The operation of the shift guide mechanism 4 causes the upper end of one of the guide plates 41 to push one surface (a left hand surface as viewed in figures) of the sheet S rightward to direct such sheet portion to the nip of the second pair of rollers. Consequently, a portion folded into a U-shape is formed in the sheet S at a location in proximity to the nip of the second pair of rollers by the outer peripheral surface of the central roller 31 and the upper end of the guide plate 41. Then, such portion is clamped between the second pair of rollers to form a first folded line F1 as shown in FIG. 5. Thereafter, by continuing that retreating of a proceeding portion SP proceeding from the first folded line F1 which is provided by the first pair of rollers and that advancing of a first succeeding portion SF1 succeeding to the first folded line F1 which is provided by the feed roller mechanism 2, the proceeding portion SP and the first succeeding portion SF1 of the sheet S are overlapped on each other through the first folded line F1, thus completing a first folding. At this time, a first folded portion P1 temporarily discharged from the second pair of rollers is in an attitude supported to extend angularly upwardly by the sheet supporting member 15.

This operation is continued to a point when the length of the first folded portion P1 travelling beyond the nip of the second pair of rollers becomes an intended value.

Step C:

At a point when a second folded portion of the sheet S has reached the outlet end 44 of the shift guide mechanism 4 and moreover, the lead or head SH of the sheet S is still clamped and held between the first pair of rollers, the shift mechanism 37 is returned, and the direction of rotation of the working roller mechanism 3 is again reversed into the normal direction. The feed roller mechanism 2 is maintained in a condition of rotation in the normal direction.

The returning of the shift mechanism 37 causes the shift press roller 33 to be moved reversely to the direction in the step A, i.e., to be shifted in the state remaining in press contact with the central roller 31 along the outer peripheral surface of the central roller 31 from the shifted position B to the access position A, while the shift guide mechanism 4 is returned from the shifted position to the normal position.

Figure 6:
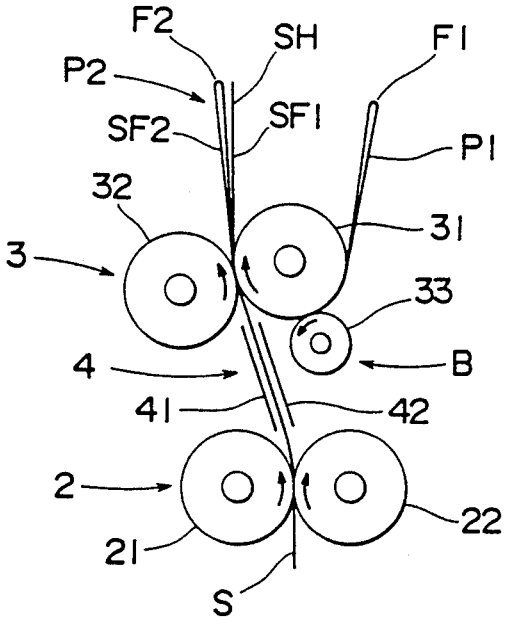

This movement of the shift guide mechanism 4 causes the upper end of the other guide plate 42 to push the other surface (a right hand surface as viewed in FIGS.) of the sheet S leftward at a trailing end location of the first folded portion P1 to direct it to the nip of the first pair of rollers. As a result, a portion folded into a U-shape is formed in a second succeeding portion SF2 following the first succeeding portion SF1 at a place in proximity to the nip of the first pair of rollers by the outer peripheral surface of the central roller 31 and the upper end of the guide plate 42 and is then clamped between the first pair of rollers to form a second folded line F2 as shown in FIG. 6. Thereafter, by continuing that readvancing of the first succeeding portion SF1 proceeding from the second folded line F2 which is provided by the second pair of rollers and that advancing of the second succeeding portion SF2 following the second folded line F2 which is provided by the feed roller mechanism 2, the first succeeding portion SF1 and the second succeeding portion SF2 of the sheet S are overlapped on each other through the second folded line F2, thus completing a second folding. A second folded portion P2 discharged from the first pair of rollers is supported by the discharge guide 14 in an attitude to extend upwardly in an overlapped relation to the lead or head SH.

The sheet S processed into a so-called form folded in three as a whole by folding oppositely in respect to the first folded line F1 and the second folded line F2 in the above manner is discharged through the sheet discharge opening 12 by the discharge rollers 19 as a result of continuing the above-described operation of the feed roller mechanism 2 and the working roller mechanism 3.

Following the above step C, the sheet S may be folded in a further multiple manner by repeating the steps B and C again.

In the above description, the distance from the leading end to the firstfolded line F1 formed in the sheet S may be determined by controlling the rate of sheet fed by the feed roller mechanism and the length of time from a feed start point to a point of operation of the shift mechanism 37. However, it is necessary for the lead or head portion SH of the sheet S to be still clamped between the first pair of rollers at operation of the shift mechanism 37.

As described above, with the sheet folding apparatus of the present invention, the shift guide mechanism 4 is shifted between the normal position and the shifted position, whereby the direction of the sheet S pointed at the working roller mechanism 3 is changed between to the first pair of rollers and to the second pair of rollers, and the position of the shift press roller 33 is changed between the access position A and the shifted position B, while at the same time, the direction of rotation of the working roller mechanism 3 is alternately reversed in a corresponding manner. In one of the normal condition and the shifted condition, the sheet portion is clamped between one of the pairs of rollers, followed by the changing into the other condition. In this condition, such sheet portion is fed reversely to form the U-shaped portion at an intended location of the sheet, and with a succeeding sheet portion fed by the feed roller mechanism being overlapped on the reversely fed sheet portion with such U-shaped portion as a lead or head, the sheet portion is passed between the other pair of rollers. Accordingly, the formation of the folded line in the sheet can be performed several times in an alternately reversely folding manner and ultimately, the sheet can be multiply folded.

In the working roller mechanism 3, the shift press roller 33 constituting the second pair of rollers by cooperation with the central roller 31 is held for movement in press contact with the central roller 31 between the access position A and the shifted position B along the outer peripheral surface of the central roller 31 and hence, in the shifted position B, the folding by the second pair of rollers can be reliably achieved. Thereafter, when the shift press roller 33 is returned to the access position A, or when it is further shifted to the shifted position B, a sheet to be folded is guided along the outer peripheral surface of the central roller 31. With an action of the guide plates 41 and 41 being also applied, this ensures that the U-shaped portion is formed in the sheet, and the distance of reverse feed of the sheet required for folding is reduced. Consequently, it is possible to provide a satisfactory intended folding without an attendant relative slippage between sheet portions already folded and overlapped on each other.

On the other hand, if the shift press roller 33 is not shiftable, and when the sheet folded by the second pair of rollers consisting of the shift press roller 33 and the central roller 31 is intended to be subjected to a subsequent folding by the first pair of rollers with only the shift guide mechanism 4 being shifted, a large slippage is produced between the folded and overlapped sheet portions, resulting in an obstruction of difficulty to allow the sheet to enter the first pair of rollers in an intended proper attitude.

In folding the sheet S a plurality of times in the working roller mechanism 3 by bringing the press roller 32 and the shift press roller 33 into press contact with the central roller 31 by the resilient force of the spring in a condition capable of being slightly spaced apart from the central roller 31, and even when the folded sheet is of an increased thickness, the press roller 32 and the shift press roller 33 are shifted relative to the central roller 31 in accordance with such thickness and hence, any unreasonable force is prevented from acting on the sheet to produce wrinkles.

With the apparatus according to the present invention, it is possible to provide a sheet folded in alternate faces by alternately repeating the folding operation by one of the pairs of rollers and the folding by the other pair of rollers as described above, and it is possible to easily control the location of each folded line to provide an optimal folded state by detected the top position of the lead or the head of the sheet or the folded sheet to control the rate of sheet fed by the feed roller mechanism 2.

As discussed above, the apparatus of the present invention is of a simple construction and small-sized, and enables a large sheet to be reliably folded a plurality of times to provide an required folded state.

Although one embodiment of the present invention has been described above, it will be understood that the following various modifications can be made:

(1) The working roller mechanism may be of a construction such that both of two rollers in press contact with the central roller may be movable along the outer peripheral surface of the central roller in a condition remaining in press contact with the central roller and with the mutual positional relationship therebetween being maintained, so that when one of such rollers is in the access position, the other roller may be in the shifted position, while when the one roller is in the shifted position, the other roller may be in the access position. With this construction, even in folding a sheet, particularly a plurality of times more than two, it is prevented to produce any transfer failure due to a slippage between the folded and overlapped sheet portions;

(2) The specified construction of the shift mechanism is particularly not limited, and various means can be employed;

(3) The shift means of the shift guide mechanism is particularly not limited, and those of various constructions can be employed. When shifting into the normal position or the shifted position has been performed, however, it is necessary for the outlet end of the shift guide mechanism to be in an attitude directed to the nip of one or the other of the pairs of rollers; and (4) The drive control system for the shift guide mechanism as well as the drive control systems for the rollers of the feed roller mechanism and the working roller mechanism, the introducing roller and the discharge roller are particularly not limited, and the presently known various control mechanisms can be utilized.

What is claimed is

1. A sheet folding apparatus comprising a feed roller mechanism consisting of a pair of rollers adapted to feed a sheet clamped therebetween; a working roller mechanism mounted on the outlet side of said feed roller mechanism in a line in the same direction as said pair of rollers of said feed roller mechanism and consisting of a central roller, a press roller in press contact with one side of said central roller, and a shift press roller in press contact with the other side of said central roller; and a shift guide mechanism mounted between the feed roller mechanism and the working roller mechanism, said shift press roller of the working roller mechanism being held for shifting movement between a first or access position where it is opposed to the press roller and a second or shifted position where it is in press contact with the other side of said central roller, along an outer peripheral surface of said central roller in a condition remaining in press contact with said central roller, said shift guide mechanism including a pair of guide plates defining a sheet passage, and being shiftable between a normal position and a shifted position in operative association with said shift press roller, said shift guide mechanism being designed so that when it is in the normal position, an inlet thereof is located at a nip of the feed roller mechanism, while an outlet thereof is directed to a nip between the central roller and the press roller in said working roller mechanism, and when it is in the shifted position, the inlet is located at the nip of the feed roller mechanism, while the outlet is directed to the nip betweem the central roller of said working roller mechanism and the shift press roller in the shifted position, whereby the sheet is folded through the following steps;

a step A of passing a sheet to be folded, fed by the feed roller mechanism between the central roller and the press roller in the working roller mechanism with the shift guide mechanism in the normal position;

a step B of shifting the shift guide mechanism from the normal position to the shifted position, moving and shifting the shift press roller from the normal position to the shifted position along the outer peripheral surface of said central roller in a condition remaining in press contact with the central roller, while at the same time, reversely rotating the central roller, and passing the sheet, with a sheet portion reversely fed by the central roller and the press roller and a succeeding sheet portion fed by the feed roller mechanism being overlapped over each other, between the central roller and the shift press roller, thereby folding the sheet; and a step C of shifting the shift guide mechanism from the shifted position to the normal position, returning the shift press roller in a condition remaining in press contact with the central roller along the outer peripheral surface of said central roller to the access position, while at the same time, again reversing the central roller, and passing the folded sheet portion reversely fed by the central roller and the shift press roller and a further succeeding sheet portion fed by the feed roller mechanism, in a condition of these sheet portions overlapped over each other, between the central roller and the shift press roller, thereby folding sheet.

2. A sheet folding apparatus according to claim 1, further including a shift mechanism having a connecting plate swingable about an axis provided at a support shaft of the central roller, a support shaft of the shift press roller being supported on said connecting plate, said shift guide mechanism being connected to said connecting plate, so that the shifting movement of the shift press roller and the shifting displacement of the shift guide mechanism may be performed.

3. A sheet folding apparatus according to claim 1, further including an introducing mechanism which comprises an introducing guide plate and an introducing roller adapted to slip on the introducing guide plate; and discharge rollers.

4. A sheet folding apparatus according to claim 1, further including sheet supporting member for supporting a sheet portion temporarily discharged from the nip between said central roller and said shift press roller which is in the shifted position.

5. A sheet folding apparatus according to claim 1, wherein both of the press roller and the shift press roller in the working roller mechanism are mounted for movement along the outer peripheral surface of said central roller in a condition remaining in press contact with said central roller and with a mutual positional relationship maintained, so that when one of said rollers is in the access position, the other is in the shifted position, while when the one is in the shifted position, the other is in the access position.

* * * * *